United States Patent [19]

Figueroa et al.

[11] Patent Number: 4,590,966

[45] Date of Patent: May 27, 1986

[54] CONTROL-VALVE SYSTEM AND BLOCK FOR A FLUID-OPERATED CYLINDER-AND-PISTON ASSEMBLY

[75] Inventors: David S. Figueroa; Jorge A. P. Heredia, both of Monterrey, Mexico

[73] Assignee: Vitro Tec Fideicomiso, Monterrey, Mexico

[21] Appl. No.: 604,505

[22] Filed: Apr. 27, 1984

[30] Foreign Application Priority Data

Apr. 28, 1983 [MX] Mexico ..... 197100

[51] Int. Cl.[4] ..... F15B 13/044

[52] U.S. Cl. ..... 137/596.17; 65/DIG. 13; 91/6; 91/31; 91/449; 91/454

[58] Field of Search ..... 65/DIG. 13; 91/6, 449, 91/454, 31; 137/596.17

[56] References Cited

U.S. PATENT DOCUMENTS

| | | | |
|---|---|---|---|
| 2,999,482 | 9/1961 | Bower | 91/6 X |
| 3,038,449 | 6/1962 | Murphy et al. | 91/6 X |
| 3,164,065 | 1/1965 | Frantz | 91/449 X |
| 4,367,087 | 1/1983 | Franco et al. | 65/DIG. 13 X |
| 4,518,011 | 5/1985 | Stoll | 137/596.17 |

*Primary Examiner*—Gerald A. Michalsky

*Attorney, Agent, or Firm*—Abelman Frayne Rezac & Schwab

[57] ABSTRACT

A control valve includes a monolithic valve body incorporating dual digital valves and dual by-pass valves interconnected with each other by ducts within the valve body and providing for either controlled or uncontrolled actuation of a piston in either a forward or a reverse direction of movement.

2 Claims, 5 Drawing Figures

CONTROL-VALVE SYSTEM AND BLOCK FOR A FLUID-OPERATED CYLINDER-AND-PISTON ASSEMBLY

FIELD OF THE INVENTION

This invention relates to a control-valve assembly for controlling a fluid-operated piston and cylinder.

BACKGROUND OF THE INVENTION

Digital valves are well known, and consist generally of a valve block with two sets of conduits which are interconnected by a plurality of orifices of various diameters. Solenoid operated plungers selectively open and close various combinations of the orifices, so as to control the total volume of fluid passing through the valve.

Digital valves have been widely used for controlling the drive of piston and cylinder assemblies. Usually a digital valve is provided in the supply line, and a separate digital valve is provided in the return line in order to control the return movement of the piston. Two additional digital valves must be provided to reverse the supply and return flows.

The above circumstances cause the operational cost to increase considerably, for it is necessary to control four separate and independent digital valves, thus increasing the complexity of the associated data processing equipment.

If control of the piston over both its forward and return stroke is required, this requires the addition of additional digital valves, which must be operated by corresponding logic circuits, further increasing the cost of the system, particularly when great accuracy or complex movements of the piston are required.

For long time there has been a need for a digital control valve which can control the return stroke of the piston in addition to controlling the forward stroke.

SUMMARY OF THE INVENTION

It is an object of this invention to provide an improved digital control valve assembly of simple construction, and which can provide control of a piston in both in a forward and a reverse direction.

Another object of the invention is to provide a digital control valve assembly which may be easily constructed, is highly reliable, and can be operated with high efficiency.

A further object of the invention is to provide a digital control valve assembly that can be controlled by fewer logic controlling circuits, without detriment to the precision of movement of the cylinder and piston assembly, and which can provide control such movement in accordance with complex algorithms fed into the related data processing unit.

A more specific object of the invention is to provide a digital control valve assembly in which all of the valve elements are integrated into a single unit while at the same time providing accurate control of forward and rearward movements of an associated piston and cylinder assembly.

According to the present invention the digital control valve assembly includes a monolithic valve body incorporating a first digital valve assembly having an inlet and an outlet, a second digital valve assembly having an inlet and an outlet, and first and second by-pass valves.

Each of the digital valves and the by-pass valves is incorporated into a unitary valve body having first, second, third and fourth ducts. The first and third ducts respectively constitute a fluid inlet and outlet of the first digital valve, and the second and third ducts respectively constitute a fluid inlet and outlet of said second digital valve.

The first by-pass valve includes a passage interconnecting the first and second ducts and, the second by-pass valve includes a passage interconnecting the third and fourth ducts.

Solenoids are provided for independently actuating each of the first and second digital valves and the first and second by-pass valves between an open and a closed position.

The first duct is connected to a supply of fluid under pressure, and the second and third ducts are connected to the working chamber respectively on opposite sides of the piston. The fourth duct exhausts to atmosphere.

By this construction, a supply of fluid under pressure connected to the first duct is operative to move the piston in either of a controlled or an uncontrolled manner in one direction on opening of the by-pass valves, and is operative to move the piston in either a controlled or an uncontrolled manner in an opposite direction on closing of the by-pass valves.

Preferably, the respective digital valves are solenoid operated valve having a plunger moveable into a through orifice in order to provide for instant and easy opening or closing of said valves.

DESCRIPTION OF DRAWINGS

The invention will now be described with reference to the accompanying drawings in which.

DESCRIPTION OF THE PREFERRED EMBODIMENT

Figure 1:
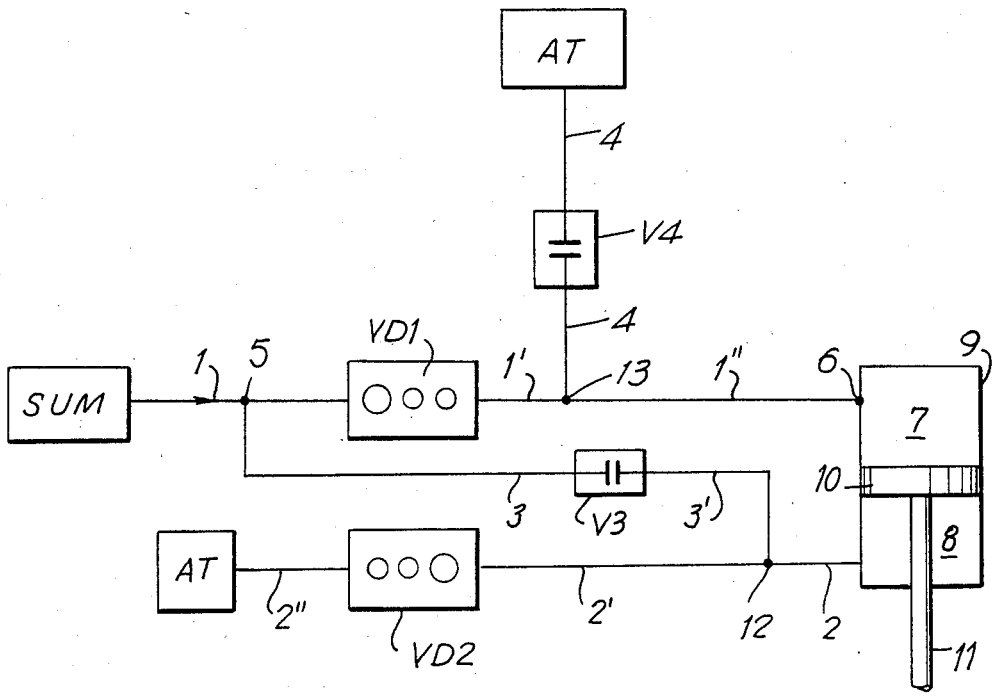
FIG. 1 is a flow diagram of a circuit incorporating multiple control valves, each of which is incorporated as an into the digital control valve of the present invention as an integral unit of the valve.

Referring now to FIG. 1, a supply source SUM, is connected by means of a fluid conduit 1 with a first digital valve VD1. A conduit 1',1'', connects an outlet of the first digital valve VD1 with an inlet 6 of an upper chamber 7 of a cylinder 9 of the piston and cylinder having a piston 10 and a drive rod 11.

A conduit 4 extends from an intermediate point 13 on the conduit 1',1'' and connects with an exhaust valve V4, open to atmosphere at AT.

A conduit 2,2' connects a lower chamber 8 of cylinder 9 to a second digital valve VD2, which opens to atmosphere at a through conduit 2''.

A by-pass valve V3 is connected at 5 with the conduit 1 by a conduit 3, and is connected at 12 with the conduit 3'.

During downward movement of piston 10, fluid is admitted into the chamber 7 and discharged from the chamber 8. Valves V3 and V4 are closed during this movement, and valves VD1 and VD2 are operated in accordance with the program of the associated data processing system. Fluid under pressure from the fluid supply SUM passes through valve VD1 and through conduits 1,1',1'' into the upper chamber 7 of the cylinder 9, at an accurately controlled rate. Digital valve VD2 is separately operated in accordance with the program of the associated data processing system, and permits the controlled discharge of fluid from chamber 8 through line 2,2'2", to discharge at atmosphere AT.

To operate piston 10 in an upward direction, in an uncontrolled manner, valves VD1 and VD2 are closed and valves VC3 and V4 are then opened in accordance with the program of the data processing system. Fluid from the supply SUM then passes through line 1, point 5, line 3, through by-pass valve V3, line 3, point 12, line 2, and into chamber 8 of cylinder 9. Fluid in chamber 7 of cylinder 9 is discharged through point 6, line 1", point 13, line 4, and through exhaust valve V4 to atmosphere AT. Piston 10 is thus caused to effect its upward movement within cylinder 9 in an uncontrolled manner, i.e., at ful capacity of the valves V3 and V4.

Controlled upward movement of piston 10 is produced by appropriate operation of digital valves VD1 and VD2, in accordance with the program of the data processing systm, as hereafter described.

Fluid from the supply source SUM passes directly through fully open by-pass valve V3 and into chamber 8 of cylinder 9. Opening digital valve VD2 in an appropriate manner, permits a partial discharge of the fluid in lines 2,2', and a reduction in the pressure of the fluid entering the chamber 8, The rate of fluid exhaust from chamber 7 of cylinder 9 is controlled by operation of digital valve VD1 in accodance with the program of the data processing system. Digital valve VD1 is partially opened, thus permitting fluid under pressure from the supply SUM to creating a controlled back pressure in the conduit 1" and regulate the speed of upward movement of the piston 10.

Figure 2:
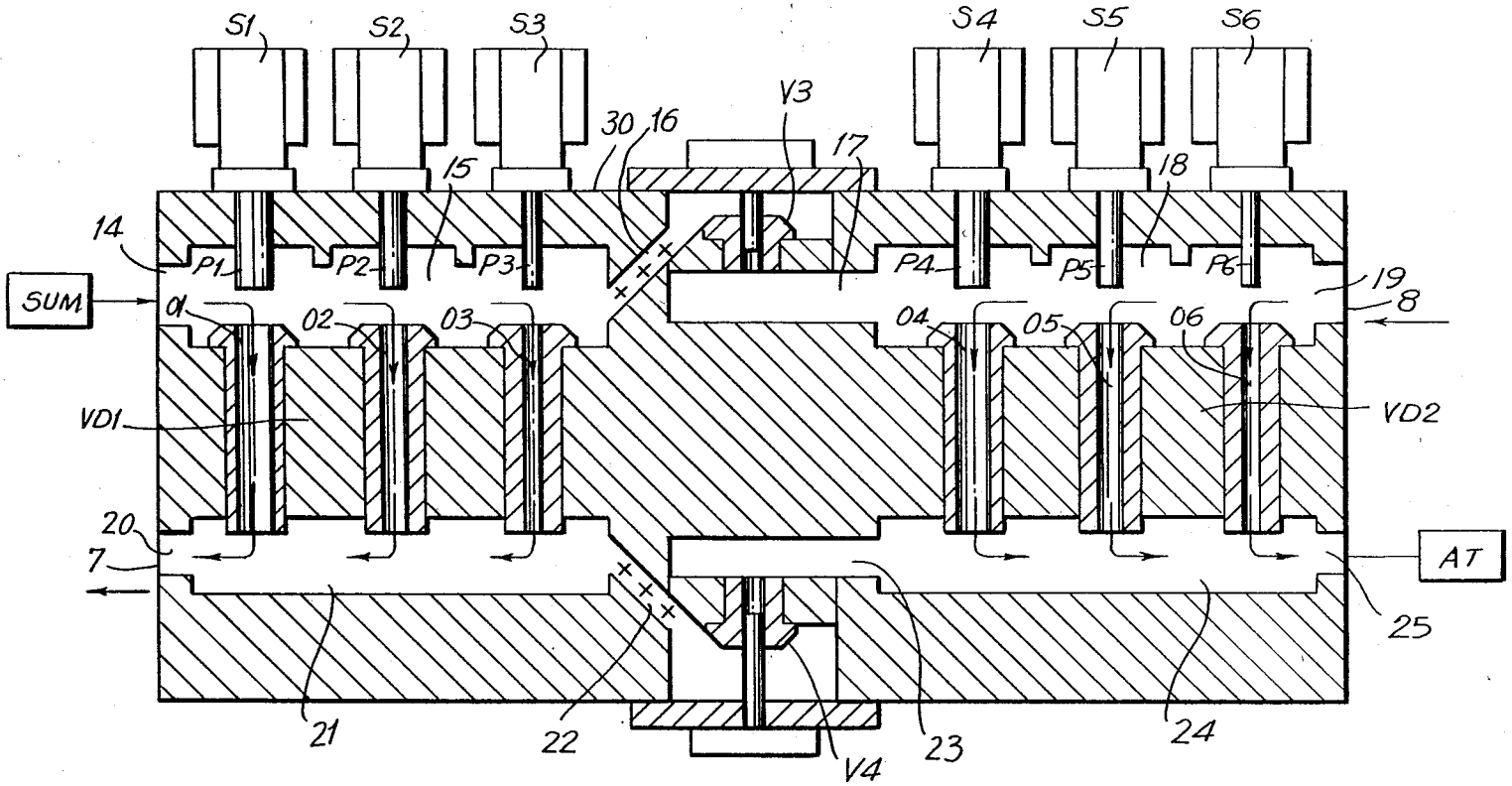
FIG. 2 is a diagramatic cross section through the integrated digital control valve of the present invention.
Figure 3:
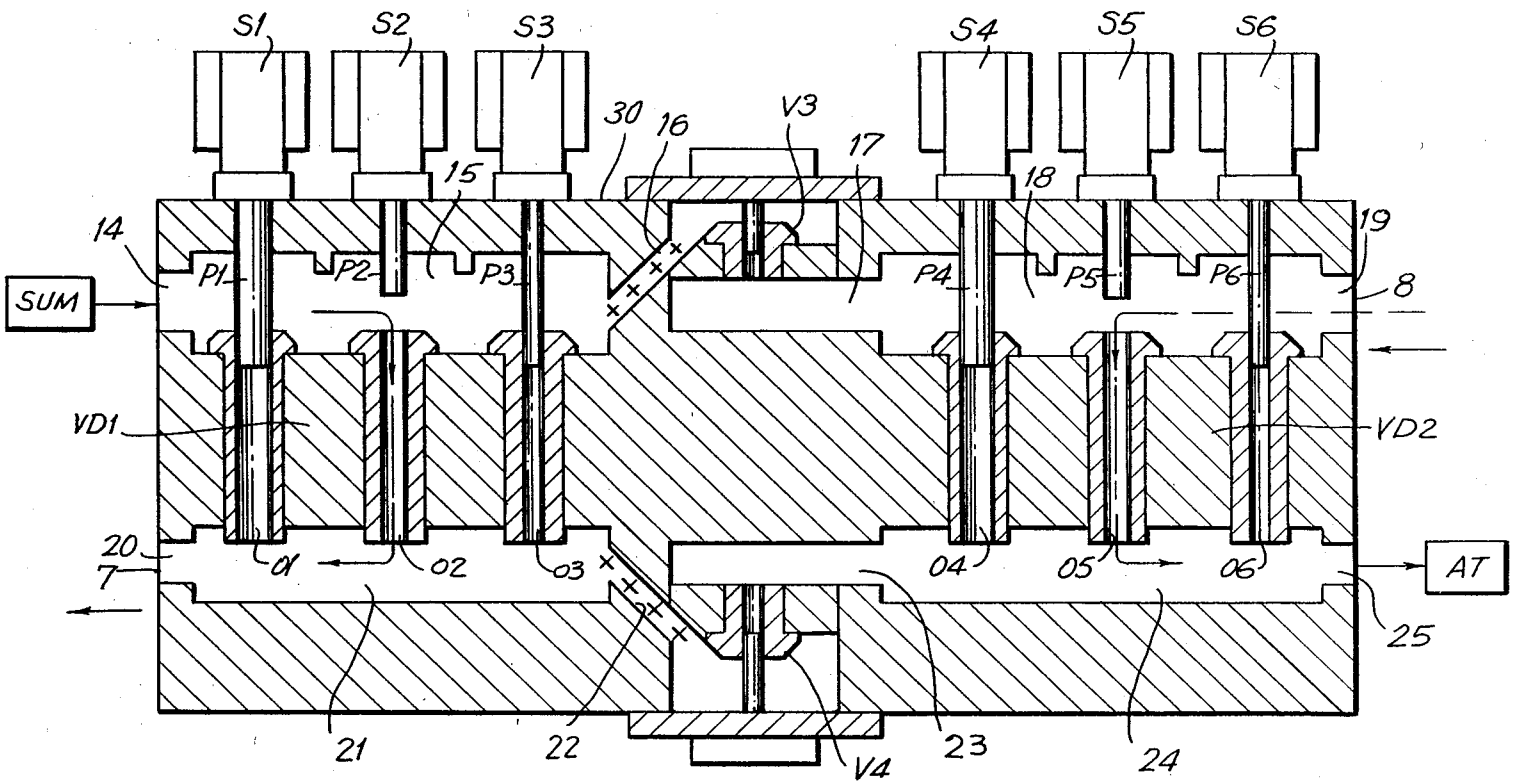
FIGS. 3, 4 and 5 illustrate alternative control positions of the valve of FIG. 2.

Referring now to FIG. 2 of the drawings, there is diagrammatically illustrated an integrated valve block 30 incorporating digital valve VD1 at one of its ends, digital valve VD2 at its opposite end, and of by-pass and exhaust valves V3 and V4 positioned intermediate its ends on opposite sides of the valve block 30.

The respective digital valves VD1 and VD2 each include control orifices O1–O6 and plungers P1–P6, respectively controlled by solenoids S1–S6. The by-pass valves V3 and V4 are similarly constructed.

The block 30 has four sets of internal ducts, which are selectively interconnectable to provide all of the functions of the system of FIG. 2 in a single integrated unit, when appropriately connected to the supply source SUM and to the piston and cylinder 9 and 10.

A first duct 14–16 is connected to the supply source SUM at the duct portion 14, and continues into a position 15 incorporating the inlets of digital valve VD1. The duct prtion 15 continues into a duct portion 16 which connects with the by-pass valve V3.

A second duct 17–19 has a duct portion 17 which commences at the by-pass valve V3 and continues into a duct portion 18 incorporating the inlets of digital valve VD2. Duct portion 18 continues into a duct portion 19 providing for the connection of the lower chamber 8 of the cylinder 9.

The third and fourth ducts are provided on the opposite side of the block 30, and respectively opposite the first and second ducts.

The third duct 20–22 includes a duct portion 20 connected with the upper chamber 7 of the cylinder 9, and which continues into a duct portion 21 incorporating the outlets of digital valve VD1. The duct portion 21 continues into a duct portion 22 which connects with the by-pass valve V4.

The fourth duct 23–25 has a duct portion 23 which commences at the by-pass valve V4 and continues into a duct portion 24 incorporating the outlets of digital valve VD2, and, discharges to atmosphere through duct portion 25.

The valve block of FIG. 2 of the drawings is capable of the same functions as the entire system of valves illustrated in FIG. 1, and operates in the following way.

The by-pass valves V3 and V4 remain closed during downward movement of the piston 10. Pressurized fluid from the source SUM, passes through the duct portion 14 and into the duct portion 15 of valve VD1. As the valve V3 is closed, the fluid cannot pass through the duct 16, and instead passes through the orifices of the valve VD1 and into the duct portion 21 of the third duct, and then to chamber 7 of the cylinder 9.

The fluid return from chamber 8 is through the duct portion 19 and into the duct portion 18 of digital valve VD2. The by-pass valve V3 is closed, and thus, fluid cannot pass through the duct portion 17, but instead passes through the orifices of the digital valve VD2, into the duct portion 24, and therefrom, through duct portion 25 to the atmosphere.

Figure 4:
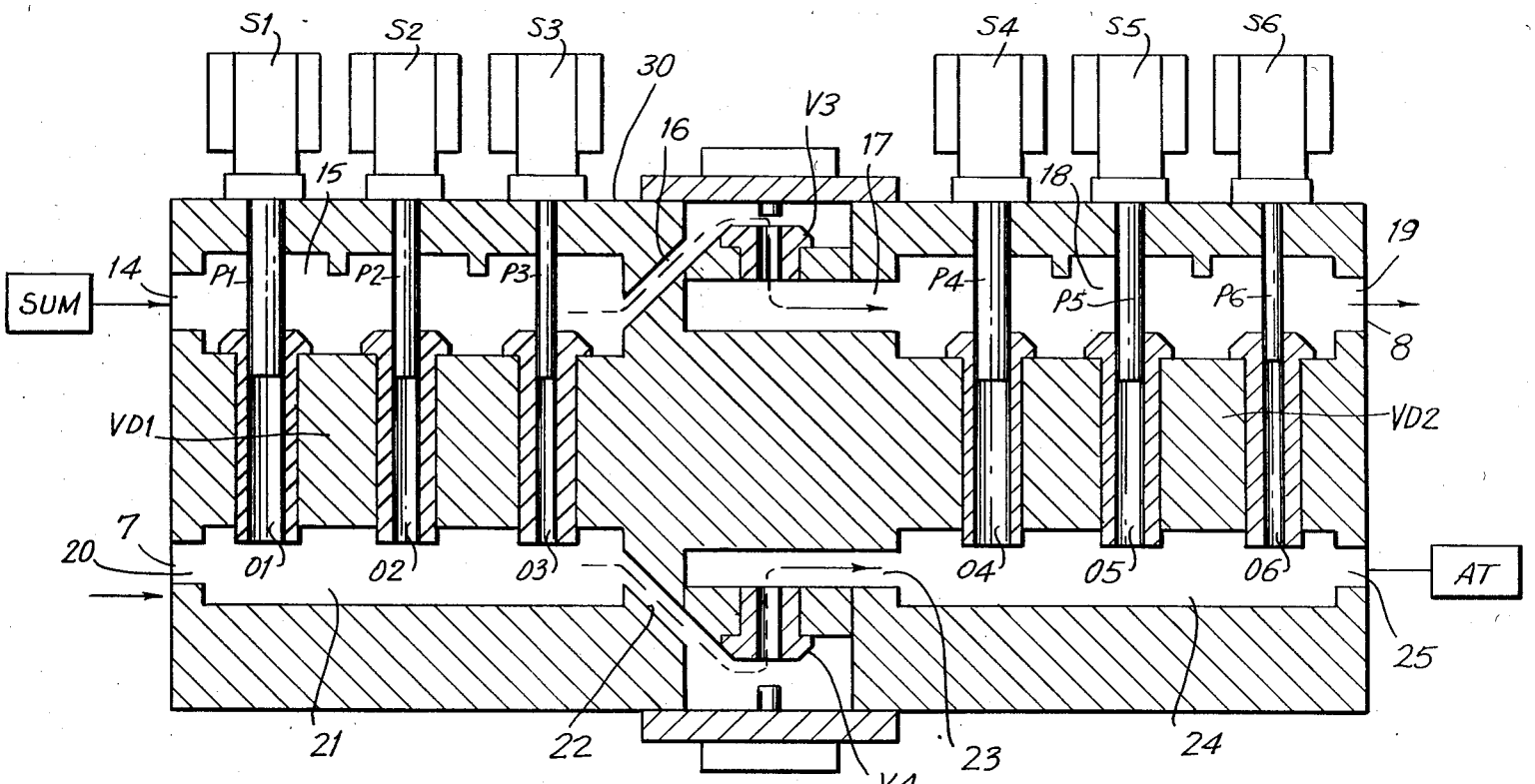
Figure 5:
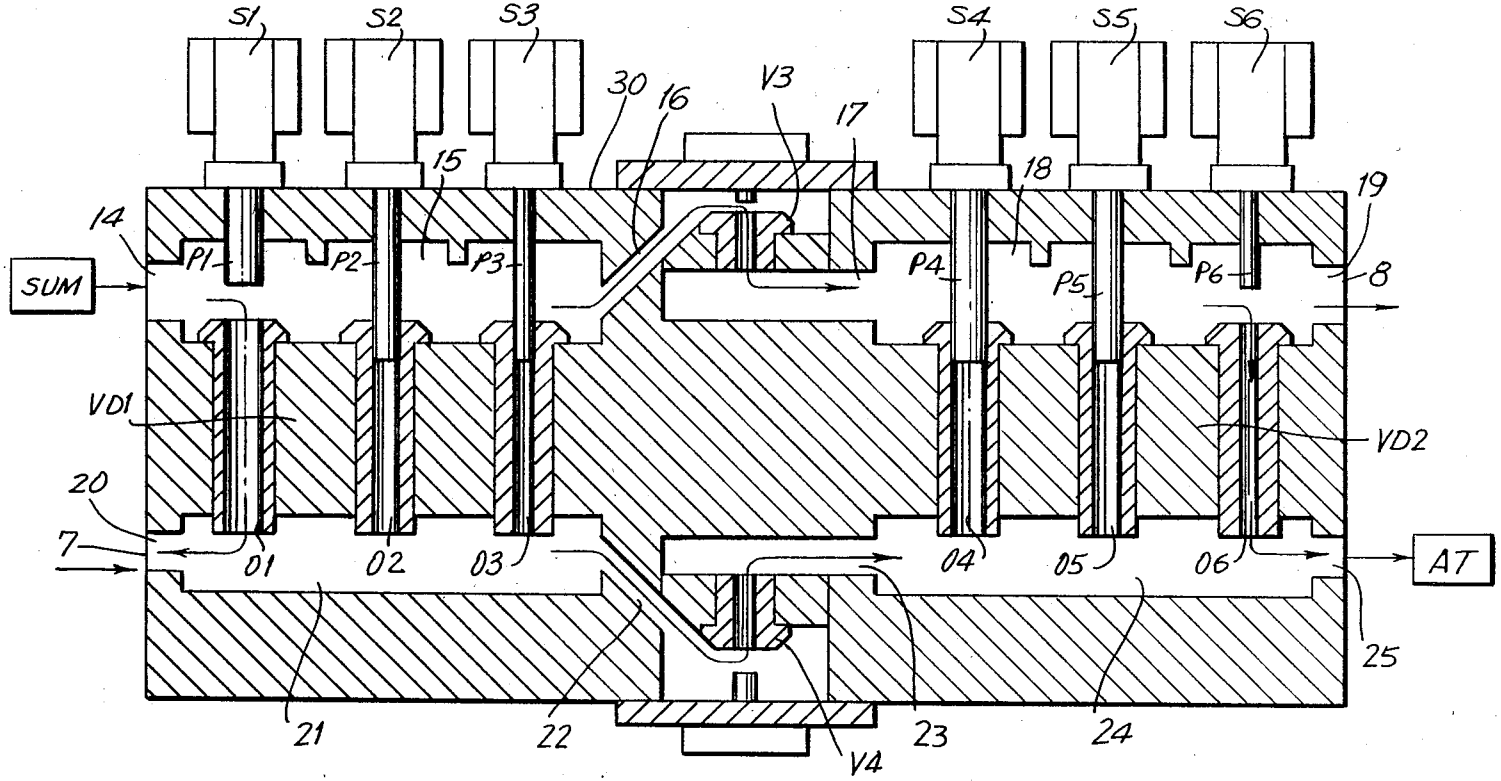

During the normal upward movement of piston at full capacity, digital valves VD1 and VD2 are totally closed and by-pass valves V3 and V4 are completely opened by the data processing system, as shown in FIG. 4. In this position of the respective valves, fluid from the supply source SUM passes through the duct portions 14 and 15 of digital valve VD1 and through duct portion 16. As by-pass valve V3 is open, the fluid then passes through duct portions 17, 18 and 19 of digital valve VD2, and into chamber 8 of cylinder. The fluid in chamber 7 of cylinder, in turn, returns to the block 30 through duct portions 20, 21 and 22 of digital valve VD1. As by-pass valve V4 is open, fluid then passes through duct portions 23, 24 and 25 of digital valve VD2 to atmosphere, thereby performing the rearward movement of the piston 10 at full capacity of the system.

If it were desired to effect the upward stroke in a controlled manner, then, with by-pass valves V3 and V4 fully open, digital valves VD1 and VD2 are controlled by the data processor. As valve VD1 opens, part of the fluid coming from the supply source SUM passes directly through orifices O1–O3 of valve VD1, thereby decreasing the pressure of fluid available to chamber 8 of cylinder. The fluid passing through the orifices O1–O3 provides a back pressure in the fluid returning from chamber 7 to the third duct 20–22, and which is exhausted to atmosphere via the by-pass valve V4 and the fourth duct 23–25. Furthermore, if digital valve VD2 is also adequately controlled, fluid returning from chamber 7 of cylinder is hindered from passing to the atmosphere by the back pressure exerted on the duct 23–25 by fluid passing the orifices O4–O6 and into the duct portion 24, thereby imparting a twofold control to inflow to the chamber 8 and outflow from the chamber 7 to atmosphere.

From the above may be seen that the digital valve assembly of the present invention is equally effective in controlling movement of the piston in either direction either at full capacity or in a controlled manner, without the need to provide separate digital valves to control return movement of said piston in the cylinder.

What is claimed is:

1. A digital control valve assembly for controlling the movement of a piston within a working chamber, including:

a monolithic valve body incorporating each of:

a first digital valve assembly having an inlet and an outlet, and a second digital valve assembly having an inlet and an outlet;

first and second by-pass valves;

each of said digital valves and said by-pass valves being incorporated into said valve body, said valve body providing first, second, third and fourth internal ducts;

said first and third ducts respectively constituting a fluid inlet and a fluid outlet of said first digital valve;

said second and fourth ducts respectively constituting a fluid inlet and a fluid outlet of said second digital valve;

said first by-pass valve including a passage interconnecting said first and second ducts;

said second by-pass valve including a passage interconnecting said third and fourth ducts;

means for independently actuating each of said first and second digital valves and said first and second by-pass valves between an open and a closed position;

means for connecting said first duct to a supply of fluid under pressure;

means for connecting said second duct and third duct to said working chamber respectively on opposite sides of said piston;

and means for connecting said fourth duct to atmosphere;

whereby a supply of fluid under pressure connected to said first duct is operative to move said piston in one of a controlled and uncontrolled manner in one direction on opening of said by-pass valves, and is operative to move said piston in one of a controlled and uncontrolled manner in an opposite direction on closing of said by-pass valves.

2. The digital control valve assembly of claim 1, in which each of said digital and by-pass valves includes a plunger operable by a solenoid and which is receivable in an orifice member associated with the valve body to close said orifice.

* * * * *